United States Patent [19]

Kahrs

[11] Patent Number: 4,566,870

[45] Date of Patent: Jan. 28, 1986

[54] ADJUSTABLE VANE-TYPE PUMP

[75] Inventor: Manfred Kahrs, Wiesbaden, Fed. Rep. of Germany

[73] Assignee: ITT Industries, Inc., New York, N.Y.

[21] Appl. No.: 527,250

[22] Filed: Aug. 29, 1983

[30] Foreign Application Priority Data

Nov. 2, 1982 [DE] Fed. Rep. of Germany ..... 3240367

[51] Int. Cl.[4] ..... F01C 21/16

[52] U.S. Cl. ..... 418/30; 418/27

[58] Field of Search ..... 418/30, 31, 24, 25, 418/26, 27

[56] References Cited

U.S. PATENT DOCUMENTS

| | | | |
|---|---|---|---|
| 2,975,717 | 3/1961 | Rynders et al. | 418/26 |
| 3,107,628 | 10/1963 | Rynders et al. | 418/26 |
| 3,664,776 | 5/1972 | Mills et al. | 418/30 |
| 3,918,855 | 11/1975 | Bornholdt | 418/30 |

FOREIGN PATENT DOCUMENTS

| | | | |
|---|---|---|---|
| 2914282 | 10/1980 | Fed. Rep. of Germany | 418/26 |

*Primary Examiner*—Stephen F. Husar

*Attorney, Agent, or Firm*—James B. Raden

[57] ABSTRACT

In an adjustable vane-type pump, there is provided an idle stroke adjusting device for variation of the pre-compression. The device comprises a laterally arranged adjustable supporting element having a substantially planar supporting surface bearing against the curved supporting surface area of the cam ring. The plane of the supporting surface of the supporting element is inclined relative to the plane which is defined by the joint axis of the delivery-limiting device and the pressure-control device as well as by the rotor axis. The curved supporting surface area of the cam ring is formed by the cylindrical peripheral surface of the cam ring. By using this extremely straightforward idle stroke adjusting device, wherein the idle stroke adjustment changes in response to the output pressure and the flow rate, respectively, a more favorable noise emission over the entire operating range of the pump is accomplished.

1 Claim, 2 Drawing Figures

ADJUSTABLE VANE-TYPE PUMP

The present invention relates to an adjustable vane-type pump with a rotor encircled by a displaceable cam ring within a pump housing, with a pressure-control device and with a laterally arranged adjustable supporting element having a substantially planar supporting surface for the cam ring; the cam ring in turn, comprising a curved supporting surface area so that in the event of a change in position of the cam ring in the direction of the pressure-control device, a transverse change in position of the cam ring will occur.

Vane-type pumps of this type perform a stroke while pressure increases-prior to and in the initial pressure phase i.e. a stroke with pre-compression-which may have effects on the operating noises. This stroke in the pre-compression phase will be referrred to as idle stroke. The delivery stroke of the pump compartments is performed in controllable vane-type pumps by displacement of the cam ring on the transverse axis in the direction of the control spring. The openings for inlet and outlet of the fluid (pockets) are arranged correspondingly. If the cam ring is in addition displaced vertically relative to the mentioned transverse axis by means of the setscrew the so-termed idle stroke of the compartments results, which does not contribute to the pump delivery. The compartments increase during suction stroke and pump delivery by a specific amount and decrease by the same amount again while they still communicate with the opening for inlet or outlet (pocket).

To minimize operating noises, it is known to provide such rotary vane-type pumps with adjustable devices for the setting of the idle stroke. But idle stroke adjustment of this device minimizes operating noises only under specific operating conditions.

In adjustable vane-type pumps, however, there is need for noise reduction over the entire operating range of the pump. One type of idle stroke adjustment is known from German printed and published patent application No 25 10 959, wherein the adjustment varies over the entire operating range. To this end, a plane supporting surface is provided for the cam ring, the surface extending in parallel to the plane which is defined by the joint axis of the delivery-limiting device and the pressure-control device as well as by the rotor axis. The cam ring includes a curved shaped supporting surface area, the curvature thereof extending in the direction of the sliding surface of the cam ring. To ensure roll-off movement, the cam ring and supporting element are positively locked by a pivot of the supporting element, the said pivot being arranged in a blind-end bore of the cam ring. This type of idle stroke adjusting device is extremely complicated due to the need for manufacturing the curved surface of the cam ring and designing the unit of pivot and bore.

It is therefore an object of the present invention to arrange for an extremely straightforward idle stroke adjustment, the latter providing the minimization of noise over the entire operating range of the pump.

This object is achieved by the present invention in that the supporting surface of the ring supporting element is inclined in the direction of the pressure-control device relative to the plane through the axis defined by the pressure-control device and the axis of the rotor, and in that the exterior curved supporting surface area of the cam ring is formed by the cylindrical peripheral surface of the cam ring.

The curved supporting surface of the cam ring cooperates with the substantially planar inclined supporting surface of the supporting element so that, with the delivery stroke decreasing, i.e. with the output pressure rising, an increasing idle stroke and thus an increase of the pre-compression will be accomplished.

It is particularly simple and straightforward to use the cylindrical peripheral surface of the cam ring as the curved supporting surface, since this obviates the need for separate shaping of the supporting surface area. Also the provision of the substantially planar supporting surface at the supporting element is very easy to implement.

In one improved embodiment of this invention, the supporting surface is formed by the end face of the supporting element enabling manufacture at minimal cost.

In a further expedient embodiment the supporting surface is positioned at right angles relative to the axis of the supporting element. In this arrangement, the axis of the supporting element is positioned at an acute angle relative to the axis of the pressure-control device rather than at right angles thereto. Thus, there is no need to arrange for a supporting surface inclined relative to the axis at the supporting element so that a conventional threaded bolt can be made use of in a particularly favorable manner which will be screwed into a threaded bore in a correspondingly disposed housing attachment. The supporting surface will at all times be located in the spatially correct position independently of the torsion angle of the threaded bolt. The setting of radial distance of the supporting element relative to the rotor axis can be performed most simply by torsion of the threaded bolt; locking thereof can be effected by a check nut.

One improved embodiment provides that the supporting surface is the end face of an element which projects through an opening in the pump housing in a torsionally secured fashion. In this design, the supporting structure for the element can be arranged at right angles relative to the pressure-control device, while the supporting surface is aligned most simply to the curved cam ring periphery in a spatially correct manner.

In particular in applications entailing high loads, it will be favorable to produce the supporting element with a composite construction comprising a threaded bolt and a square insert element and to form the supporting surface at the end of the square element.

To avoid edge pressures, it is preferable that the surface of supporting element is curved and abuts on the cam ring substantially by point contact. Favorably, this supporting surface can be designed as a section of a spherical segment. Expediently, the center of curvature is disposed on the axis of the supporting element. Because of the small height of the spherical segment compared to the radius of curvature, the supporting surface remains almost plane.

Embodiments of the present invention will be described in more detail in the following with reference to the accompanying drawings. In the drawings, FIG. 1 is a cross-sectional view of a vane-type pump employing my invention;

FIG. 2 is another embodiment of a vane-type pump using my invention.

DETAILED DESCRIPTION

Figure 1:
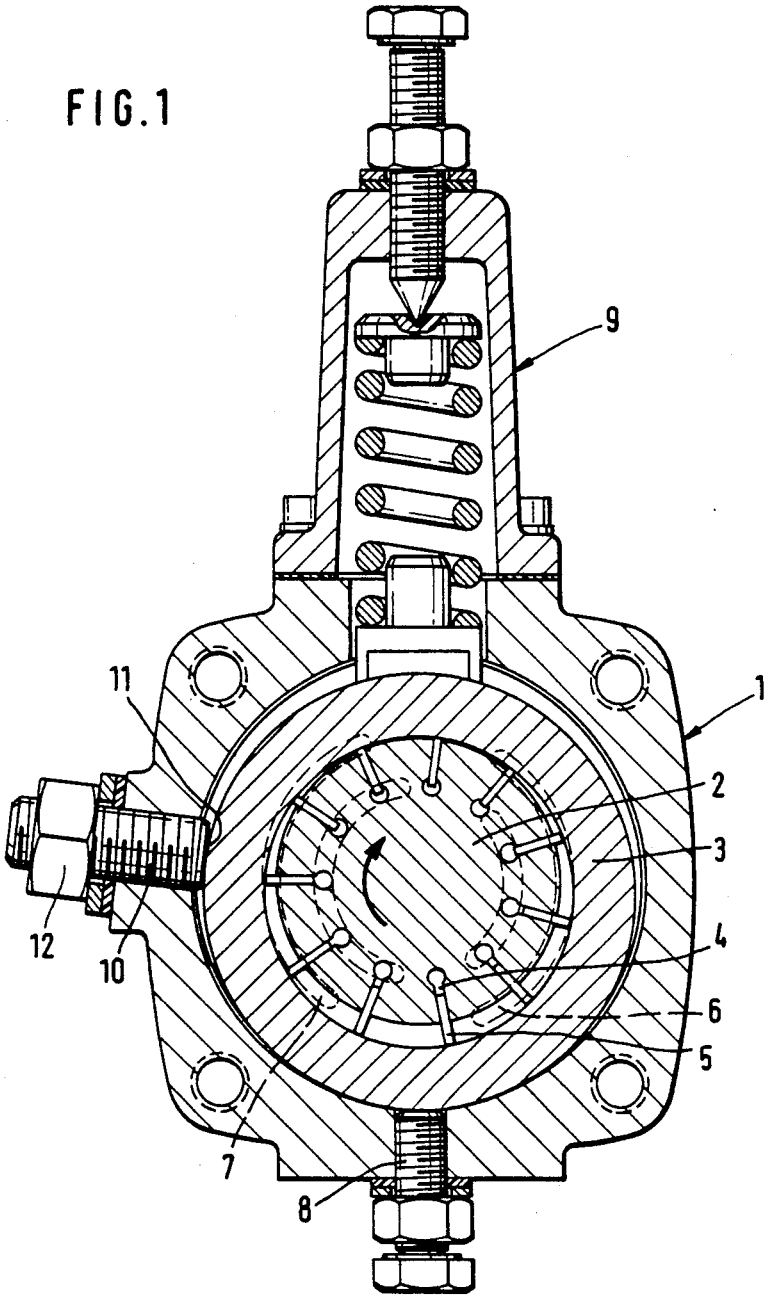

In the vane-type pump illustrated in FIG. 1, a pump housing designated by reference numeral 1 encloses a central rotor 2 and a cam ring 3 external to the rotor. Arranged in the rotor 2 over the entire axial extent of the rotor are radially extending slots 4 in which vanes 5 are radially slidably guided to position their outwardly directed end faces in abutment with the inner surface of the cam ring 3 that encircles the rotor 2. The working chamber disposed between rotor 2 and cam ring 3 is subdivided by the vanes 5 into working compartments which are closed in an axial direction on both sides by lateral discs (not shown).

The lateral discs contain control openings which serve for the pressure fluid supply and discharge, respectively. The one control opening thereof being the suction port 6 shown in dashed line form, while the other is the pressure port 7.

In the position illustrated in FIG. 1, the cam ring 3 has maximum eccentricity relative to the rotor 2, and the vane-type pump is consequently at its maximum capacity. In this arrangement, the cam ring 3 abuts on a setscrew 8 which serves as delivery-limiting device and by which the maximum capacity can be adjusted. Diametrally opposite to this delivery-limiting device setscrew 8 is a pressure-control device 9 by means of which the maximum output pressure can be predetermined by setting the preload of a spring assembly which urges the cam ring 3 against the setscrew 8.

The suction port 6 is arranged on one side of the connecting line between these diametrally opposite devices 8,9, while the pressure port 7 is arranged on the other side thereof. Pre-compression of the pressure fluid takes place in the area of the working chamber formed between cam ring 3 and rotor 2, the said area being disposed on the side of the delivery-limiting device 8 between suction port 6 and pressure port 7, while a subsequent expansion takes place in the diametrally opposite area.

A supporting element 10 for the cam ring 3 is arranged on the pressure port side, its axis being disposed at an acute angle relative to the axis of the pressure-control device 9 defined as a line through the rotor axis and the axis of pressure control device 9. The supporting element 10 is designed as a threaded bolt which extends through a threaded bore in the pump housing. The tip of the bolt 10 forms a plane supporting surface 11, the surface being located perpendicular to the bolt's axis and positioned to bear against the cam ring 3. The supporting element 10 is adjustable in a radial direction by torsion applied in advancing or retracting the bolt. The position set by the adjustment is secured by a check nut 12 resting against the housing surface.

Due to the described positioning of the supporting element 10 at an acute angle, the supporting surface of element 10 is inclined at an angle relative to the plane which is defined by the joint axis of delivery-limiting device 8 and pressure-control device 9 as well as by the axis of the rotor 2. During the displacement of the cam ring 3 into the idle stroke position that is substantially coaxial relative to the rotor 2, the plane supporting element 10 and the curved cam ring peripheral surface cause displacement of the cam ring 3 normal to the delivery-adjusting direction. This setting causes continuous increase of the pre-compression so that the suppression of noises will be optimized in response to the output pressure adjustment.

Figure 2:
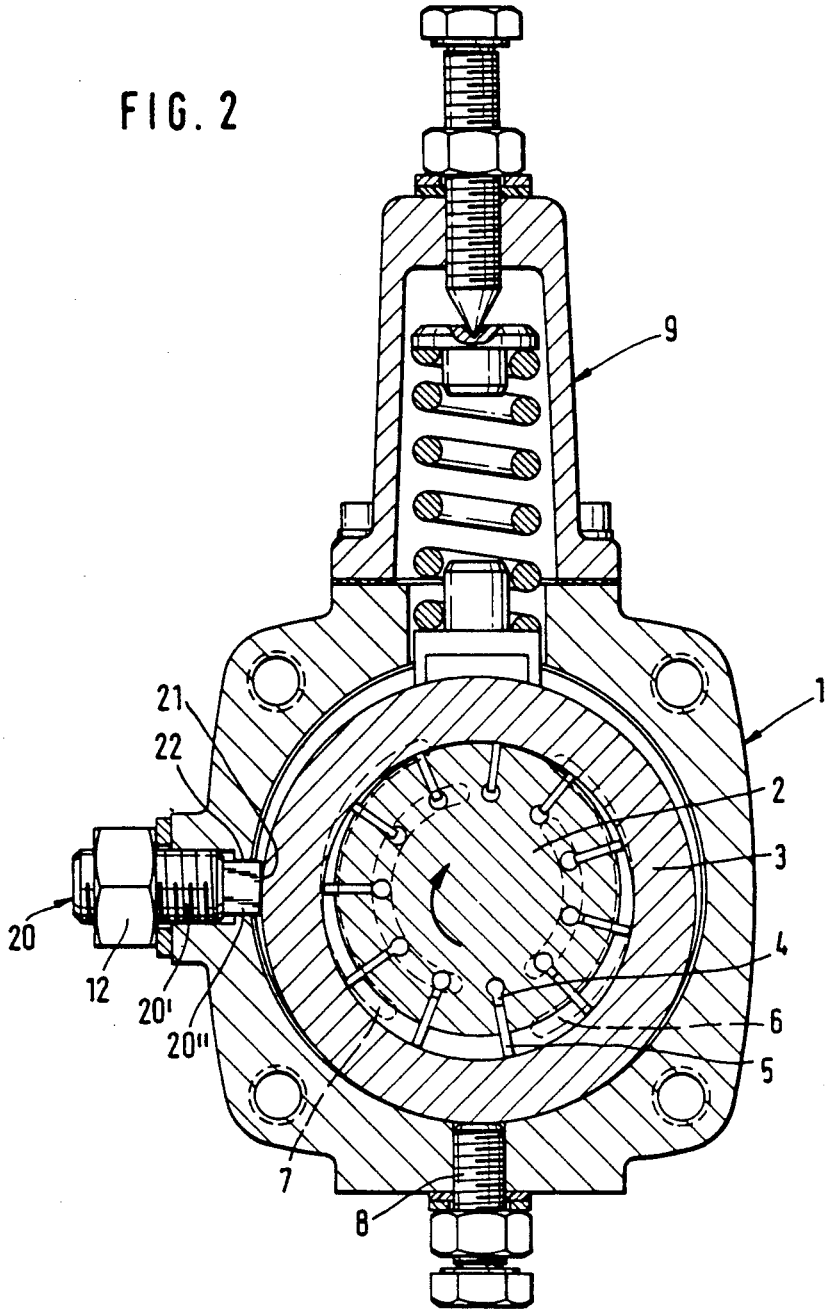

In the vane-type pump illustrated in FIG. 2, which apart from the supporting element 20 corresponds to the pump of FIG. 1, the axis of the supporting element 20 is arranged at right angles relative to the joint axis of delivery-limiting device 8 and pressure-control device 9. The supporting surface 21 of element 20 is disposed at a specific angle relative to the longitudinal axis of the supporting element 20 and is inclined in the direction of the pressure-control device 9, similar to that shown in FIG. 1. The supporting element 20 of FIG. 2 is of bipartite or composite design comprising a threaded bolt 20' and a square insert element 20'', the insert containing the supporting surface 21. In the pump housing 1, there is formed adjacent to the threaded bore, a square opening 22 through which penetrates the square element 20''. The supporting surface 21 designed at the square element 20'' allows the bolt to be easily mounted in the spatially correct position and to be adjusted by torsion of the threaded bolt 20' in a radial direction. Securement of the set position of the bolt is again effected by a check nut 12.

I claim:

1. An adjustable vane-type pump comprising an enclosing housing, a rotor rotatable on an axis within said housing past a suction port on one side of the rotor and a pressure port on the opposite side of said rotor, means in said rotor on rotation thereof for placing said ports in communication to pump fluid from the suction port to the pressure port, a cam ring eccentrically encircling said rotor and displaceable radially relative to said rotor, said cam ring comprising an outer curved surface resting within said housing, means for adjusting the position of said cam ring radially relative to said rotor for limiting the volume delivered by said pump, pressure control means diametrically opposite said position adjustment to set a bias pressure applied to said cam ring, and a further adjusting means at the pressure port side of the cam ring and positioned to bear against the cam ring to control the pre-compression of fluid passing from said suction port to said pressure port, said further adjusting means comprising a planar surface applying a settable pressure against said cam ring, said planar surface comprising the end face of a bolt threaded through an opening in the enclosing housing to bear against said cam ring, said bolt being inclined at a single predetermined acute angle relative to the axis of the pressure control means with said planar surface applied generally at the axis of said rotor to the extension of said cam ring, to minimize noise over the operating range of the pump.

* * * * *